United States Patent [19]

Kisler et al.

[11] Patent Number: 4,457,256

[45] Date of Patent: Jul. 3, 1984

[54] PRECHARGED WEB COATING APPARATUS

[75] Inventors: Semyon Kisler, Newton; Edwin A. Chirokas, Lexington; Donald A. Foster, Lakeville, all of Mass.

[73] Assignee: Polaroid Corporation, Cambridge, Mass.

[21] Appl. No.: 222,331

[22] Filed: Jan. 5, 1981

[51] Int. Cl.[3] ..... B05B 5/02; B05C 5/02

[52] U.S. Cl. ..... 118/621; 118/626; 118/636; 118/638; 361/213

[58] Field of Search ..... 118/621, 626, 636, 638; 361/213, 221, 229; 250/324, 325, 326; 427/26, 27

[56] References Cited

U.S. PATENT DOCUMENTS

| | | | |
|---|---|---|---|
| 2,774,921 | 12/1956 | Walkup | 250/325 |
| 3,196,270 | 7/1965 | Rosenthal | 250/324 |
| 3,474,292 | 10/1969 | Carter | 361/213 |
| 3,671,806 | 6/1972 | Whitmore et al. | 317/2 R |
| 3,702,258 | 11/1972 | Gibbons et al. | 118/638 |
| 3,707,138 | 12/1972 | Cartwright | 118/638 |
| 4,086,872 | 5/1978 | Pan | 118/638 |
| 4,088,093 | 5/1978 | Pan | 118/638 |
| 4,402,035 | 8/1983 | Kisler | 361/213 |

OTHER PUBLICATIONS

Patent Application Serial No. 183,326, filed Sep. 2, 1980, Kisler, "Low Voltage Electrostatic Charge Regulating Apparatus."

"Controlling Polar Charge With Low Electrical Potentials", Andrews et al., Research Disclosure, Feb. 1980.

*Primary Examiner*—S. L. Childs

*Attorney, Agent, or Firm*—John J. Kelleher

[57] ABSTRACT

Improved electrostatically assisted coating apparatus for placing an electrostatic dipole-type charge, of a predetermined magnitude, on material to be coated before and/or remote from the location where the coating is actually applied to said material by a coating applicator.

16 Claims, 3 Drawing Figures

PRECHARGED WEB COATING APPARATUS

BACKGROUND OF THE INVENTION

1. Field of the Invention

The present invention relates to means for coating charge retaining materials with electrostatically assisted coating apparatus, in general, and to such apparatus for coating a moving web of such material, in particular.

2. Description of the Prior Art

In the manufacture of various coated products it is often essential that coating materials applied to such products be of uniform thickness. In, for example, the continuous manufacture of coated photographic sheet materials, a non-uniform thickness coating applied to a moving web of said materials may seriously interfere with the final quality of a finished product that employs such nonuniformly coated materials. Product properties such as optical, photooptical, chemical reactions (e.g., image dye migration, developer permeation, etc.), visual, aesthetic and/or cosmetic effects are but some of the said properties that may be adversely affected by non-uniform coatings. Many properties of photographic film and photographic products, for example, such as sensitivity to light, color saturation, etc., can also be adversely affected when constructed with nonuniformly coated sheet materials.

Furthermore, nonuniform coating material thickness will require considerably more drying time for drying the thicker portions of a nonuniform coating than will be required for drying the thinner portions of said nonuniform coating. In addition, a temperature gradient that is optimum for drying said thicker coating portion is often excessive for optimum drying of said thinner coating portion. Drying time is usually the major factor limiting maximum production rates of many coated products.

Various coating and/or coating application technologies have controlled the uniformity of web coating thickness to a greater or lesser degree. However, in the production of photographic film and photographic products, for example, such coating methods have a propensity for inducing surface defects, among others, in the coating material and in addition, these coating methods very often have a detrimental effect on the sensitometry of a finished photographic film product.

One of the most effective coating thickness control techniques in present day use in the coating industry involves the use of an electrostatic field to uniformly deposit coating materials on products to be coated. In the production of photographic film and photographic products, for example, a web or sheet of material to be coated is passed between an electrically conductive support or backing roller and a coating applicator from which coating material flows onto a surface of said web. An electrostatic field is established across the gap between the coating applicator and the backing roller by a high voltage power supply whose output terminals are connected between said applicator and said roller. The electrostatic field causes a coating, of uniform thickness, to be deposited on the web surface to be coated and enables larger applicator to web gaps to be employed. While the voltage magnitude established between said applicator and said roller is less than that required to generate corona, said magnitude often exceeds 3 KV DC.

The use of electrostatically assisted coating apparatus employing voltages in the vicinity of 3 KV or more can create a number of problems. In some instances voltages of this magnitude can generate sparks which would make such apparatus unsuitable for use in an explosive or solvent environment. In other instances such voltages can produce holes in the materials to be coated, thereby rendering such materials unsuitable for their intended purposes. Also, when a short circuit or extremely low impedance path appears across a coating gap between an applicator and its associated backing roller where coating material is being electrostatically assisted by a voltage of several thousand volts as a result of an existing pinhole in the material to be coated, for example, the electrostatic assist will be temporarily interrupted by said short circuit which can cause unacceptable variations in coating thickness uniformity to occur.

A web-supporting backing roller is normally maintained at a high potential by an electrostatic-field-producing high voltage power supply. This is so because its associated coating applicator is usually grounded by the coating fluid which normally is electrically conductive, to a greater or lesser degree, and said fluid provides a low impedance path to ground through its fluid-supplying conduit. However, whether it is the backing roller or the applicator that is maintained at a high potential by said high voltage power supply, a substantial risk of electrical shock is presented to personnel in the vicinity of either said applicator or said backing roller, whichever one should be connected to the high voltage power supply output lead.

It is an object of the present invention to provide electrostatically assisted coating apparatus that can place a uniform thickness of coating material on material to be coated.

It is another object of the present invention to provide electrostatically assisted coating apparatus that can be employed in an explosive or a solvent-type environment.

It is another object of the present invention to provide electrostatically assisted coating apparatus that will not produce holes in the materials to be coated.

It is another object of the present invention to provide an electrostatically assisted coating process that is immune to preexisting pinholes and/or an extremely low impedance path through material to be coated.

It is yet another object of the present invention to provide electrostatically assisted coating apparatus that will not present a shock hazard to personnel in the vicinity of said apparatus.

It is a further object of the present invention to provide electrostatically assisted coating apparatus that can tolerate a relatively large gap between a coating applicator and its associated backing roller.

Other objects and advantages of our invention will be made readily apparent by referring to the preferred embodiments of our invention described in detail below.

SUMMARY OF THE INVENTION

In accordance with the teachings of the present invention, an electrostatic coating-gap assist method and apparatus are provided that makes unnecessary the application of a high voltage across the gap established between an electrically conductive reference member and a coating applicator spaced from said reference member. An electrostatic charge producing a corresponding electrical potential such as that produced by dipole orientation is placed on the material to be coated prior to and/or when said material is remote from the gap wherein said material is coated. An electrostatic field is produced between the electrostatically charged material to be coated and an electrically conductive reference member, whose electrical potential is different from the said potential of said material to be coated, as said material enters the coating gap between said applicator and its associated web support or backing roller, said reference member being formed by or being separate from said applicator. The electrostatic field thus produced causes a coating layer of uniform thickness to be deposited on the material to be coated across a wide range of coating gaps without presenting an explosion or shock hazard to personnel and without causing damage to or being subjected to interruptions by imperfection in the material to be coated.

DESCRIPTION OF THE PREFERRED EMBODIMENTS

Figure 1:
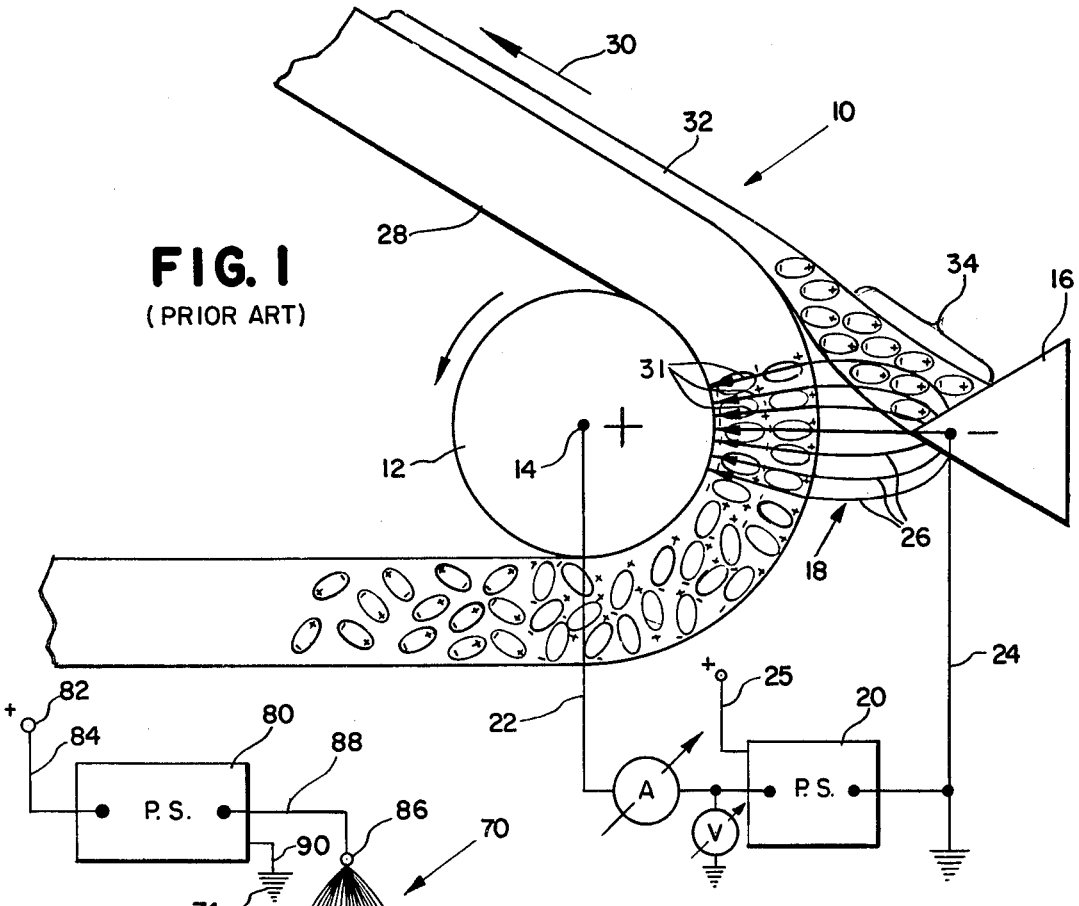
FIG. 1 (PRIOR ART)
FIG. 1 is a schematic diagram of web coating apparatus employing an electrostatic coating-gap assist technique in accordance with the teachings of the prior art.

To facilitate understanding the inventive concept of the present invention, electrostatic coating-gap assist apparatus representative of the type generally employed in the prior art will be described before a description of the present invention is initiated. Referring now to the drawings, in FIG. 1 numeral 10 generally indicates web coating apparatus employing electrostatic coating-gap assist apparatus constructed in accordance with the teachings of the prior art. In FIG. 1, web support or backing roller 12 is cylindrically shaped, is electrically conductive and is mounted for rotation about backing roller axis 14. Coating applicator 16 is mounted in a fixed position with respect to backing roller 12 and is spaced from said roller 12 by distance or gap 18. High voltage power supply 20, having a DC voltage across its output terminals that is often in the neighborhood of several thousand volts, has said output terminals connected between backing roller 12 and applicator 16 through paths 22 and 24, respectively. As noted above, the conductive coating supplied to an applicator such as applicator 16 usually maintains said applicator at or near ground potential. Therefore, the high potential terminal of power supply 20 must be connected to said roller 12 and not to said applicator 16 in order to avoid an electrical short circuit.

When power supply 20 is energized through path 25, electrostatic field 26 is produced in coating gap 18 between high potential backing roller 12 and grounded applicator 16. As charge-retaining web 28 is moved in direction 30 through gap 18 by drive means (not shown), said web 28 is electrostatically charged by orienting its dipoles (such as oriented dipoles 31) by said electrostatic field 26. The electrostatic charge produced on or in web 28 by electrostatic field 26 causes fluid 32 flowing from applicator 16 into coating gap 18 to be attracted toward and uniformly deposited on moving web 28.

An extremely important factor in the web coating process is the maintainance of an appropriate amount of coating material 32 in gap 18 for proper web-coating purposes. This portion of coating material 32 is sometimes referred to as a coating fluid bead and is designated numeral 34 in prior art FIG. 1. The surface of web 28 moves faster than the rate at which coating fluid 32 flows onto said web 28 surface. This being so, as web 28 and fluid 32 in the form of bead 34 are brought into contact with one another, the faster moving web 28 pulls and thereby stretches said fluid 32 causing the thickness of coating fluid 32 to be reduced to a desired intermediate level. It is believed that electrostatic field 26 changes coating fluid 32 properties, such as surface tension, and thereby allows said fluid 32 to be stretched to a greater degree and over a larger gap between web 28 and applicator 16 without losing or breaking bead 34 than would be possible if electrostatic gap-assisting field 26 were not present. In addition to its primary contribution of providing uniform coating layer thickness on web 28, gap 18 in FIG. 1 must be large enough to accommodate web splices so that such splices do not come in contact with applicator 16 and thereby adversely affect the web coating process such as by breaking said web 28.

Figure 2B:
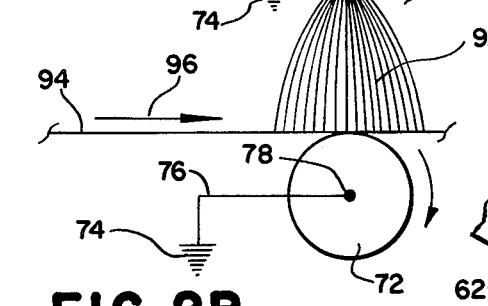
FIG. 2B is a schematic diagram of conventional corona-type web charging apparatus that may be employed as alternate, although less effective, web precharging means.
Figure 2A:
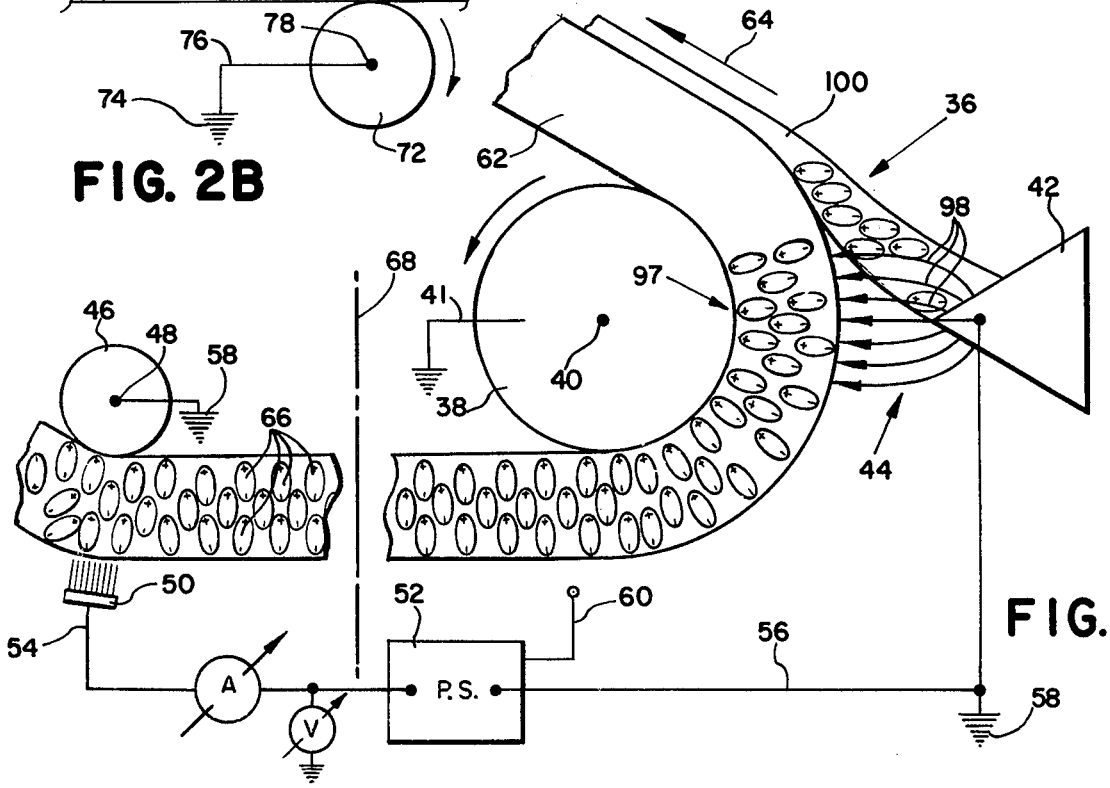
FIG. 2A is a schematic diagram of web coating apparatus employing an electrostatic coating-gap assist technique in accordance with the present invention.

Turning now to the present invention, in FIG. 2A numeral 36 generally indicates web coating apparatus employing electrostatic coating-gap assist apparatus constructed in accordance with the present invention. In FIG. 2A, web support or backing roller 38 is cylindrically shaped, is electrically conductive, is mounted for rotation about backing roller axis 40 and for safety purposes is electrically grounded through path 41 to prevent said roller from operating like a high static voltage producing Van de Graaff generator. Coating applicator 42 is mounted in a fixed position with respect to backing roller 38 and is spaced from said roller 38 by distance or gap 44.

Grounded web support or backing roller 46 is cylindrically shaped, is electrically conductive, and is mounted for rotation about backing roller axis 48. Conductive bristle brush 50 is mounted in a fixed position with respect to and has the free ends of its bristles extending toward and spaced from said grounded backing roller 46. DC power supply 52 has its high voltage output terminal connected to one end of each of the bristles of said conductive bristle brush 50 through path 54 and has its low voltage output terminal connected to grounded backing roller 46 through path 56 and common ground points 58.

When power supply 52 is engerized through path 60, a relatively intense electrostatic field is established between the free ends of the bristles of said conductive bristle brush 50 and roller 46 with a relatively low voltage (i.e., sub corona) as explained in much greater detail in copending U.S. Patent Application, Ser. No. 183,326 filed Sept. 2, 1980, in the name of S. Kisler now U.S. Pat. No. 4,402,035, which disclosure is hereby incorporated by reference. A similar but more limited disclosure of a conductive bristle brush electrostatic charge controlling technique is contained at page 70 in the February 1980 issue of Research Disclosure.

As charge-retaining web 62 is moved in direction 64 through the relatively intense electrostatic field established between energized conductive bristle brush 50 and grounded backing roller 46 by drive means (not shown), an electrostatic charge of a predetermined magnitude is established on or in said web 62. This electrostatic charge results from the orientation of dipoles in web 62 (such as oriented dipoles 66) that were so oriented when web 62 was moved through the electrostatic field between the free ends of conductive bristle brush 50 and roller 46. Conductive bristle brush 50 and backing roller 46 may be spaced a considerable distance from applicator 42 and its associated backing roller 38 as schematically emphasized by the artificial break in web 62 and by partition 68 passing through said artificial break.

Alternate though less effective means 70 for establishing an electrostatic charge on a web of charged-retaining material are schematically illustrated in FIG. 2B. Means 70 utilizes corona to establish the desired electrostatic charge level on the material to be coated. In FIG. 2B, web support or backing roller 72 is cylindrically shaped, is electrically conductive, is connected to common ground point 74 through path 76 and is mounted for rotation about backing roller axis 78. The input of high voltage power supply 80 is connected to a relatively low voltage source (not shown) at terminal 82 through path 84. The high voltage output terminal of said power supply 80 is connected to an electrode or corona source 86 through path 88 and the low voltage output lead of said power supply 80 is connected to said common ground point 74 through path 90.

In operation, when power supply 80 is energized, corona field 92 is established between corona electrode 86 and grounded backing roller 72. The desired corona level is established by manually adjusting the output voltage control means (not shown) of power supply 80 to a voltage that corresponds to said corona level. When web 94 is moved in direction 96 through said corona field 92 between electrode 86 and roller 72, ions in said corona field 92 produce an electrostatic charge level on said web 94 that corresponds to the corona level on electrode 86 established by power supply 80.

Whether it is the corona-type electrostatic charge producing apparatus of FIG. 2B or the preferred low voltage, conductive bristle-type electrostatic charging apparatus of FIG. 2A that is employed to place an electrostatic charge on web 62 in said FIG. 2B, dipoles 66 can be oriented by either of said charging apparatus so that they produce a desired electrostatic charge level. Referring again to FIG. 2A, as web 62 continues to move in direction 64, it eventually reaches the vicinity of coating gap 44 with its properly oriented electrostatic charge producing dipoles. When portion 97 of electrostatically charged web 62 is adjacent or in relatively close proximity to electrically grounded coating applicator 42, electrostatic field 98 is produced in said coating gap 44 between said web portion 97 and said applicator 42. Coating fluid 100 flowing from applicator 42 into coating gap 44 is attracted toward and is uniformly deposited on moving web 62 as a result of the electrostatic forces provided by said field 98. In addition, properties of coating fluid 100 such as its surface tension are substantially changed to thereby make possible larger gaps between coating applicator 42 and the charge-retaining material to be coated, than was heretofore possible.

DISCUSSION

The actual magnitude and polarity of the electrical potential on charge-retaining material to be coated is determined by several factors that include the type of material to be coated and the type of coating material to be deposited on said material to be coated. These factors may require a potential that is greater or less than the potential of the coating applicator whose potential is normally maintained at or very close to zero as previously discussed.

Both the corona-type electrostatic charge producing apparatus of FIG. 2B and the conductive bristle brush-type electrostatic charge producing apparatus of FIG. 2A are able to establish a polar or dipole orientation charge on charge-retaining material. However, substantially greater electrostatic charge levels can be produced on or in charge-retaining materials at any particular voltage with the brush-type electrostatic charge producing apparatus schematically illustrated in FIG. 2A.

The electrostatic field produced in gap 18 between applicator 16 and backing roller 12 by the prior art electrostatic assist apparatus of FIG. 1 is established between said applicator 16 and said backing roller 12. In order to establish an electrostatic charge on a charge-retaining material, such as web 28 in FIG. 1, electrostatic field 26 must penetrate said web 28 which introduces losses into gap 18 that substantially reduce the extent to which electrostatic forces are available to assist a coating fluid in said gap 18. By contrast, the electrostatic field in gap 44 in FIG. 2A is established between applicator 42 and precharged web 62 by the electrostatic coating gap assist apparatus of the present invention and does not have to contend with material that can reduce its ability to assist coating fluids introduced into gap 44. This being so the coating-gap assist apparatus of the present invention is able to produce greater electrostatic field intensities which makes a greater range of electrostatic forces available for the desired level of coating fluid, coating-gap assist.

The electrostatic coating-gap assist apparatus of the present invention is more suitable for use in an explosive or solvent environment because there is less likelihood of a spark being generated by the relatively low voltages used in a coating-gap by said coating-gap assist apparatus. In addition, the reduced likelihood that a spark will be generated in a coating-gap employing the coating-gap assist apparatus of the present invention, practically eliminates the possibility that an uneven layer of coating fluid might be deposited on material to be coated as a result of an interruption of the electrostatic forces present in an electrostatically assisted coating-gap, that such a spark has heretofore produced.

Electrostatic field 98 in gap 44 of the coating apparatus illustrated in FIG. 2A is established between web 12 and applicator 42 and not between backing roller 38 and said applicator 42 as in the prior art coating apparatus of FIG. 1, as previously noted. Therefore, when electric field 98 is established in said gap 44 by the coating-gap assist apparatus of the present invention web 62 is not stressed by and therefore subjected to the possibility that pinholes will be created in said web 62 by said field 9 as a similar web would be in gap 18 of the prior art apparatus of FIG. 1.

The electrostatic coating-gap assist apparatus of the present invention normally maintains the electrical potential of roller 38 and applicator 44 at or near ground potential. This being so, the shock hazard presented to personnel by high electrical potential backing roller 12 in the coating apparatus of FIG. 1 is not present in the coating apparatus of the present invention depicted in FIG. 2A.

In the preferred embodiment of the present invention described herein and schematically illustrated in FIG.

2A, an electrostatic field is established between conductive bristle brush 50 and backing roller or electrically conductive reference member 46. It is within the scope of the present invention to provide an electrically conductive reference member equivalent to said roller 46 in the form of a sheet or layer of conductive material in lieu of or in addition to said roller 46, that is either temporarily or permanently attached to a surface of said web 62 in said FIG. 2A that is remote from said brush 50.

The term "electrostatic field" employed herein means one species of electric field.

It will be apparent to those skilled in the art from the foregoing description of our invention that various improvements and modifications can be made in it without departing from its true scope. The embodiments described herein are merely illustrative and should not be viewed as the only embodiments that might encompass our invention.

What is claimed is:

1. Electric coating-gap assist apparatus comprising:

support means for supporting charge-retaining material having a predetermined dipole-type electrostatic charge for producing a corresponding electrical potential; and a coating applicator for applying coating material to said charge-retaining material, said coating applicator being mounted in spaced relation to said support means and including means for providing an electrical potential different from said predetermined charge potential, so as to produce an electric field between said charge-retaining material on said support and said applicator by virtue of the proximity of said dipole-type electrostatic charge of said charge-retaining material to said different potential applicator, to thereby assist in depositing said coating material on said charge-retaining material.

2. The apparatus of claim 1 wherein said support means supports said charge-retaining material for advancement across said support means.

3. The apparatus of claim 1 including means for providing said predetermined charge on said charge-retaining material.

4. Improved electrostatic coating-gap assist apparatus, comprising:

charge-retaining material to be coated having a predetermined dipole-type electrostatic charge thereon producing a corresponding electrical potential;

an electrically conductive reference member having an electrical potential that is different from the said potential of said charge-retaining material;

a coating applicator for applying coating material to said charge-retaining material; and means for movably supporting portions of said charge-retaining material in a spaced relation from said applicator and from said reference member to form a coating gap between said charge-retaining material portions and said applicator to thereby produce an electrostatic field between said charge-retaining material portions and said reference member by virtue of the proximity of said dipole-type electrostatic charge of said charge-retaining material to said different potential electrically conductive reference member that will cause coating material from said applicator to be uniformly deposited on said charge-retaining material as said material portions are moved into proximity with said applicator and said reference member.

5. The apparatus of claim 4, wherein said electrically conductive reference member and said coating applicator are formed of the same physical structure.

6. Improved electrostatic coating-gap assist apparatus, comprising:

charge-retaining material to be coated having a predetermined electrostatic dipole-type charge thereon for producing a corresponding electrical potential;

an electrically conductive coating applicator, having an electrical potential that is different from the said potential of said charge-retaining material, for applying coating material to said charge-retaining material; and means for movably supporting portions of said charge-retaining material in a spaced relation from said applicator to form a coating gap between said charge-retaining material portions and said applicator to thereby produce an electrostatic field between said charge-retaining material portions and said applicator by virtue of the proximity of said dipole-type electrostatic charge of said charge-retaining material to said different potential electrically conductive coating applicator that will cause coating material from said applicator to be uniformly deposited on said charge-retaining material as said material portions are moved into proximity with said electrically conductive coating applicator.

7. The apparatus of claims 4 or 6, wherein said electrical potential on said charge-retaining material is less than a magnitude that is necessary to produce a corona.

8. The apparatus of claims 4 or 6, wherein the electrostatic charge on said charge-retaining material is established with a corona field.

9. The apparatus of claims 4 or 6, wherein the electrostatic charge on said charge-retaining material is established with an electrostatic field produced with a conductive bristle brush.

10. The apparatus of claims 4 or 6, wherein the electrical potential of said material to be coated is more positive than the electrical potential of said electrically conductive reference member.

11. The apparatus of claims 4 or 6, wherein the electrical potential of said material to be coated is more negative than the electrical potential of said electrically conductive reference member.

12. The apparatus of claims 4 or 6, wherein said electric field is an electrostatic field.

13. The apparatus of claims 4 or 6, wherein said coating material is a fluid.

14. The apparatus of claims 4 or 6, wherein said coating material is a slurry.

15. The apparatus of claims 4 or 6, wherein said coating material is a dispersion.

16. The apparatus of claims 4 or 6, wherein said coating material is an emulsion.

* * * * *